US007300255B2

(12) United States Patent
Potter et al.

(10) Patent No.: US 7,300,255 B2
(45) Date of Patent: Nov. 27, 2007

(54) LAMINATED TURBOMACHINE AIRFOIL WITH JACKET AND METHOD OF MAKING THE AIRFOIL

(75) Inventors: Brian Potter, Palm Beach Gardens, FL (US); Brad Carter, Jupiter, FL (US); John Ryznic, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 246 days.

(21) Appl. No.: 11/061,313

(22) Filed: Feb. 18, 2005

(65) Prior Publication Data

US 2005/0260078 A1 Nov. 24, 2005

Related U.S. Application Data

(63) Continuation-in-part of application No. 10/646,257, filed on Aug. 22, 2003, now Pat. No. 6,857,856.

(60) Provisional application No. 60/414,060, filed on Sep. 27, 2002.

(51) Int. Cl.
*F01D 5/30* (2006.01)
*F01D 5/12* (2006.01)

(52) U.S. Cl. ..... 416/229 R; 416/229 A; 416/248

(58) Field of Classification Search ..... 416/229 R, 416/229 A, 230, 248
See application file for complete search history.

(56) References Cited

U.S. PATENT DOCUMENTS 3,731,360 A 5/1973 Stone, Jr.
3,752,600 A 8/1973 Walsh et al.
3,756,745 A 9/1973 Alver et al.
4,040,770 A * 8/1977 Carlson ..... 416/230
4,335,998 A * 6/1982 Siebels ..... 416/213 R
4,343,593 A 8/1982 Harris
4,417,854 A 11/1983 Cain et al.
4,655,687 A 4/1987 Atkinson
4,929,154 A * 5/1990 Wildner ..... 416/230
5,240,375 A 8/1993 Wayte
5,292,231 A 3/1994 Lauzeille
5,340,280 A * 8/1994 Schilling ..... 416/229 A
5,791,877 A 8/1998 Stenneler
6,004,101 A 12/1999 Schilling et al.
6,290,466 B1 9/2001 Ravenhall et al.

* cited by examiner

*Primary Examiner*—Ninh H. Nguyen
(74) *Attorney, Agent, or Firm*—Christopher & Weisberg, P.A.

(57) ABSTRACT

An improvement for a turbomachinery blade having an airfoil portion, a neck portion, and a root portion, the neck portion extending from the root portion, and the airfoil portion extending from the neck portion, and the root portion being tear-drop shaped, includes a jacket attached to the root portion and extending along a portion of the neck portion. Additionally, a process of forming a turbomachinery blade includes steps of providing a laminate of a material; providing a blade insert; wrapping the laminate around to insert to form a blade having a root portion, a neck portion extending from the root portion, and an airfoil portion extending from the neck portion; and providing for a jacket secured around the root portion and a portion of the neck portion extending from the root portion, the jacket having such shape as to prevent delamination of the laminates at a critical point due to centrifugal force acting on the blade.

15 Claims, 5 Drawing Sheets

LAMINATED TURBOMACHINE AIRFOIL WITH JACKET AND METHOD OF MAKING THE AIRFOIL

CROSS-REFERENCE TO RELATED APPLICATION

This application is a Continuation-in-part of U.S. Utility patent application Ser. No. 10/646,257 filed on Aug. 22, 2003 now U.S. Pat. No. 6,857,856, entitled TAILORED ATTACHMENT MECHANISM FOR COMPOSITE AIRFOILS, which is related to and claims priority from U.S. Provisional application No. 60/414,060 filed on Sep. 27, 2002, entitled TAILORED ATTACHMENT MECHANISM FOR COMPOSITE AIRFOILS, the entirety of which is incorporated herein by reference.

STATEMENT REGARDING FEDERALLY SPONSORED RESEARCH OR DEVELOPMENT n/a

FIELD OF THE INVENTION

The present invention relates to turbomachinery airfoils, and more specifically to a laminated airfoil used in the compressor section or a gas turbine engine or a compressor.

BACKGROUND OF THE INVENTION

Gas turbine engine blades typically have dovetails or roots carried by a slot in a metal rotor disk or drum rotor. A typical blade 1 is shown in FIG. 1 with an airfoil section 2 and a root section 3. The root section 3 provides the means by which the blade is attached and secured to the rotor disk or other similar component of a gas turbine engine or compressor of a turbomachine. The blade 1 may also include an interface 4 between the airfoil 2 and the root 3 to conform to the rotor disk or other attachment mechanism.

Composite laminated blades have many advantages over blades made with other materials, such as current metal alloys. They have a high strength to weight ratio that allows for the design of low weight parts that can withstand the extreme temperatures and loading of turbomachinery. They can also be designed with parts with design features not possible with other materials (such as extreme forward sweep of compressor blading). A major drawback of composite blades is their strength is essentially unidirectional. Despite having a relatively high uniaxial tensile strength, the composite materials are fragile and weak under compression or shear. However, in gas turbines, the blades are usually under extremely high tensile loads due to high rotational speeds of the rotor disk and blades. Problems usually arise with regard to the transfer of such loads into the disk. Since the blades are often made of a metal, the transfer of loads between the two can lead to damage of the fibers, or even worse, delamination of the blade material.

FIGS. 2*a*-2*c* show the problem discussed above, where there are shown three separate views of an example of a composite laminated blade root. FIG. 2*a* shows an unloaded blade 10*a*. FIG. 2*b* shows a blade having a tensile load T applied thereto, where the shear stress has caused a failure in the root section of the blade. FIG. 2*c* shows a loaded blade where the resulting stress from the tensile load T as applied to the blade from the surrounding disk cavity (not shown) has caused a delamination of the blade. The challenge therefore is to provide an optimum load path between the laminated blade and the surrounding disk.

Previously, one of the technology bathers for high performance composite laminated blades has been to provide an attachment scheme that would utilize the strength of composite materials to prevent the failure illustrated in FIGS. 2*b*-2*c*. As demonstrated in FIGS. 2*a*-2*b*, a critical important area is the blade attachment region or "neck" portion 11 of the blade, where the thicker root transitions out of the relatively thin airfoil section above the neck and root portions. This critical area is where the laminates of the airfoil portion of the blade that make up the pressure side and the suction side will diverge from each other and wrap around or encircle an insert to form the root portion of the blade. It is this portion which tends to delaminate or otherwise fail when the blade is loaded and the resulting stresses are applied to the root and interface between the root and disk. One reason for such failure is that the disk lugs tend to separate due to both the centrifugal force acting on the disk and blade due to high rotational speeds. FIG. 2*d* shows a blade 15 inserted into a disk 16 and under no loading from rotation. The disk lugs 17 around the neck 18 of the blade 15 define a gap $G_0$ that conforms to the shape of the blade 15. In FIG. 2*e*, the blade of FIG. 2*d* is shown under centrifugal loading, where the gap has increased in size to $G_L$. Although this geometrical change in the disk geometry is slight (the dimensions portrayed in FIGS. 2*d*-2*e* is exaggerated for effect), it no longer conforms to the shape of the blade. The effect of this slight increase in gap induces transverse tension and/or shear stresses in the blade as a result of the laminate in the blade conforming the a new shape of the slot formed in the disk due to the lugs 17 bending outward and increasing the gap.

Since composite laminated materials have little ability to handle transverse tension or shear loading, this will result in failure of the composite blade as in blade 10*c* once the intralaminar tension or shear stresses exceed the ultimate intralaminar stress capabilities of the composite material. An example would be unidirectional Kevlar composite having an ultimate intraliminar stress capability of about 6 ksi.

Also, since composite blades are very useful in a gas turbine engine, it is desirable to provide a tailored attachment mechanism of composite airfoils that both take advantage of the relatively high tensile strength of composite materials and minimizes the disadvantage of relatively low shear and transverse tension of the composite material.

U.S. Pat. No. 5,292,231 issued to Lauzeille shows a turbomachine blade made of composite laminated material, and includes a jacket wrapped around a teardrop shaped root portion. However, the jacket does not extend far along the airfoil portion of the blade to provide a compressive force against the laminates at the critical point (the point shown in FIG. 1 where the laminates digress to pass around the insert member 11). Further, the jacket does not include a thicker portion adjacent to the critical point to produce a compressive force against the laminates due to high centrifugal force acting on the blade.

SUMMARY OF THE INVENTION

In a first embodiment of the present invention, a turbomachinery blade includes a fiber reinforced composite laminate wrapped around an insert to form a teardrop shaped root portion, the laminate extending away from the root portion and joining together from a critical point formed at an end of the insert and extending to the distal end of the blade. The wrapped laminate forms a root portion and two arms extending from the root portion and joined by bonding of the laminate. The two arms form a neck portion extending from the root portion, and an airfoil portion extending from the neck portion. A jacket is secured around the root portion of the blade and extends toward the distal end of the blade just past the critical point such that the jacket prevents separation of the laminate due to high centrifugal force on the blade. The jacket has a greater thickness on the portion near the critical point than at the extreme end of the root portion. The blade can be formed from one or more laminates of the composite material.

In a second embodiment of the present invention, a turbomachinery blade includes a sheet metal material wrapped around an insert as disclosed in the above first embodiment. The two arm portions are bonded together by brazing. The laminate can optionally be bonded to the insert by brazing. The blade can be formed from one or more sheets of the metal material, where each laminate is bonded to the adjacent laminates. A jacket is secured around the root portion of the blade and extends toward the distal end of the blade just past the critical point such that the jacket prevents separation of the laminate due to high centrifugal force on the blade. The jacket has a greater thickness on the portion near the critical point than at the extreme end of the root portion.

In a third embodiment of the present invention, the blade is formed of two loop portions, one on the pressure side of the blade, and another on the suction side of the blade. The root portion includes two pins, a pressure side pin and a suction side pin. One laminate portion loops around the pressure side pin to form the pressure side root portion of the blade and the pressure side airfoil portion of the blade. The second laminate portion loops around the pressure side pin to form the suction side root portion of the blade and the suction side airfoil portion of the blade. A jacket is secured around the root portion of the blade and extends toward the distal end of the blade just past the critical point such that the jacket prevents separation of the laminate due to high centrifugal force on the blade. In this third embodiment, the laminate can be either of the fiber-reinforced composite or the sheet metal material described in the first two embodiments.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
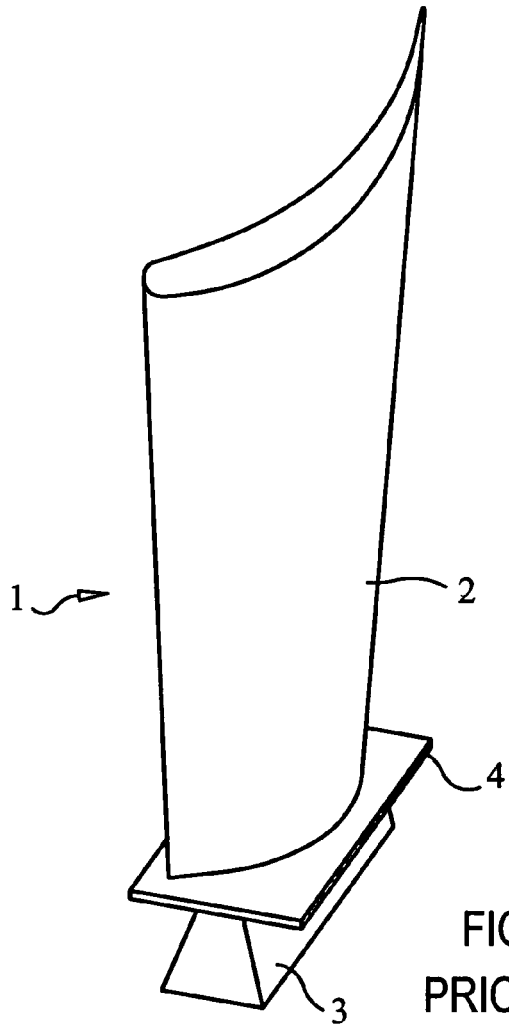
FIG. 1 PRIOR ART
FIG. 1 shows a blade of the prior art used in a gas turbine engine.
Figure 2A:
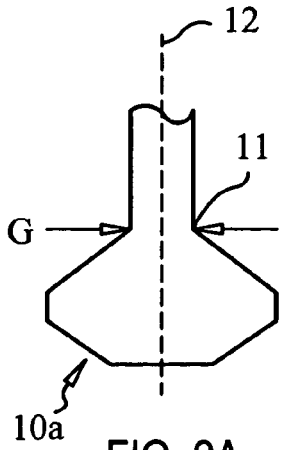
FIG. 2A PRIOR ART
FIG. 2*a* shows a blade of the prior art having no stresses acting thereon.
Figure 2B:
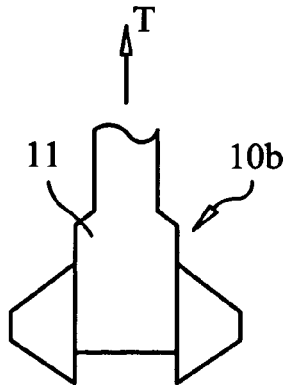
FIG. 2B PRIOR ART
FIG. 2*b* shows a blade of the prior art deforming under high tensile load due to centrifugal force acting thereon.
Figure 2C:
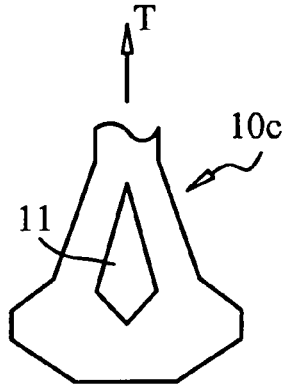
FIG. 2C PRIOR ART
FIG. 2*c* shows a blade of the prior art deforming under high tensile load in which the laminates delaminate due to high centrifugal force.
Figure 2D:
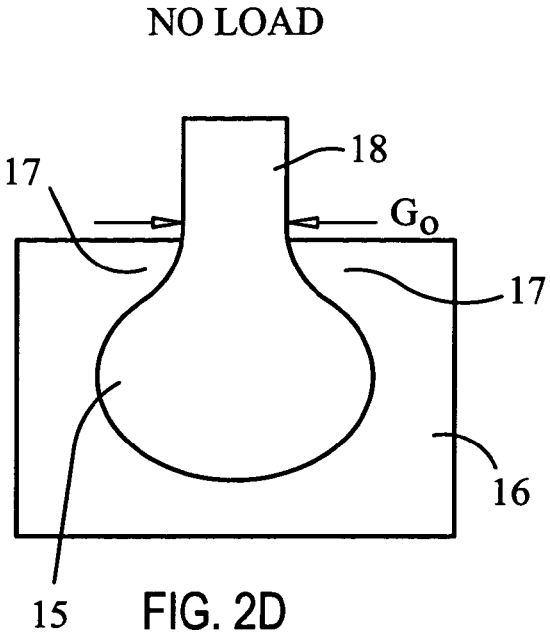
FIG. 2*d* shows a blade of the prior art inserted into a slot of a rotor disk, the rotor and the blade being under no loading.
Figure 2E:
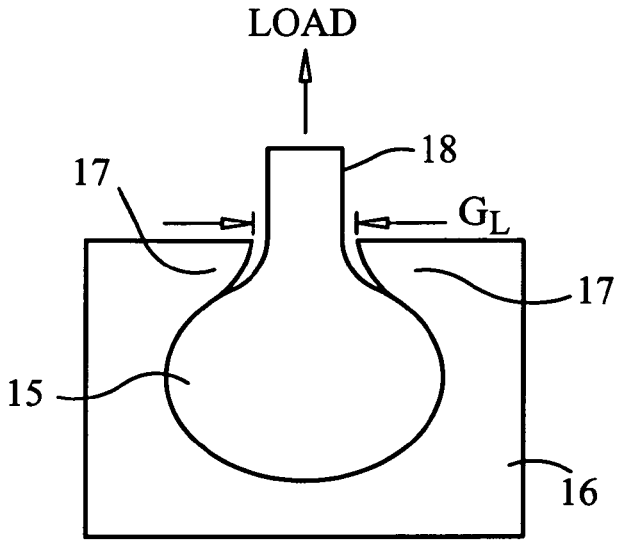
FIG. 2*e* shows a blade of the prior art inserted into a slot of a rotor disk, the rotor and the blade being under centrifugal loading.
Figure 3:
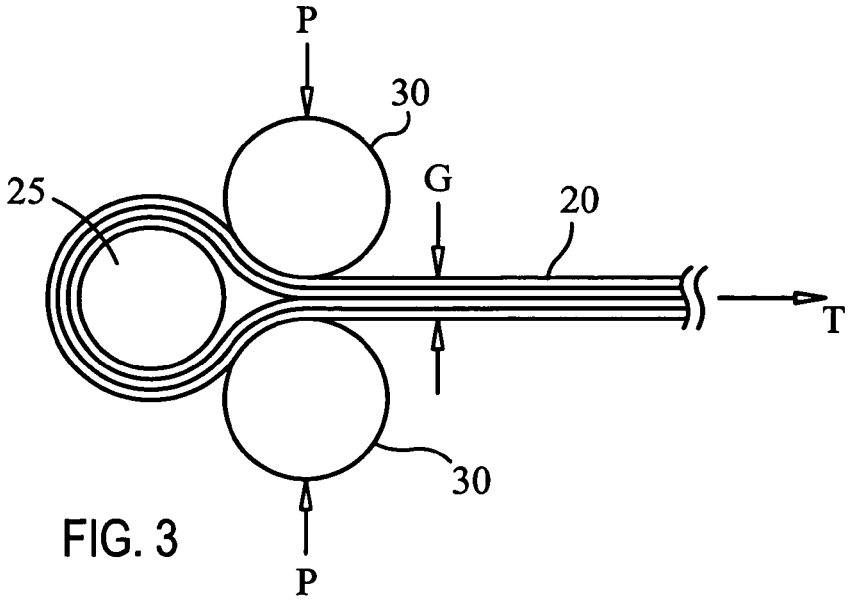
FIG. 3 shows the attachment principles employed in the present invention.

FIG. 3 is a simplified schematic of the delaminate-preventing principle employed in the present invention. A number of laminates 20 of a material (either a fiber reinforced laminated composite or a sheet metal material) are wrapped around an insert 25, the laminates being bonded together to form the airfoil portion of the blade, the airfoil portion extending along a longitudinal axis 21 of the blade. A point where the laminates digress (or, separate) from one another in the airfoil portion is considered to be a critical point, the critical point being the place where the laminates would begin to delaminate under extreme centrifugal loading of the blade. Cylinders 30 represent a point of contact on the inside surface of the jacket near the critical point. Under extreme centrifugal load, a tensile force T is created along the blade. Since the laminate wraps around the insert 25, the tensile force T will act to pull the insert 25 up against the surface of the cylinders 30. Since the cylinders 30 are relatively immobile, the tensile force T that acts to pull on the insert 25 (as well as cause the laminate to delaminate) will also produce a compressive force against the laminate at and around the critical point to overcome any force acting to delaminate the blade.

Figure 4:
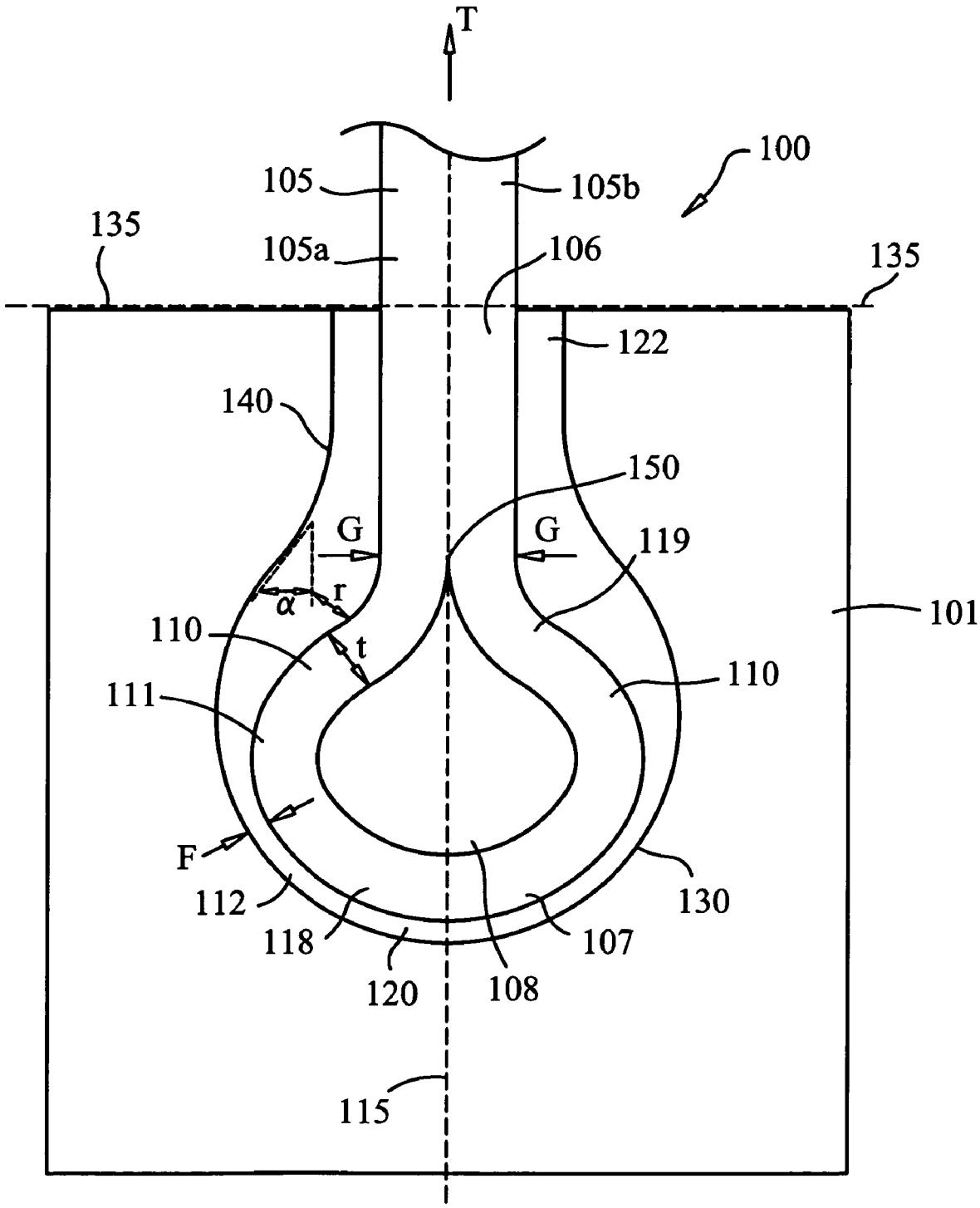
FIG. 4 shows a cross sectional view of the blade having a laminate wrapped around an insert to form the root portion of the blade, and the airfoil portion of the blade formed by joining two arms of the laminate together, and a jacket wrapped around the root portion.

FIG. 4 shows a first and second embodiment of the present invention, in which a blade 100 is secured in a slot 130 of a rotor disk 101. The blade 100 includes a root portion 107 of the teardrop shape kind, a neck portion 106 extending from the root portion 107, and an airfoil portion 105 extending from the neck portion 106. The airfoil portion includes a pressure side 105*a* and a suction side 105*b*. A jacket 112 is formed around the root portion 107 and a section of the neck portion 106. A laminate is wrapped around an insert 108 to form the root, neck, and airfoil portions of the blade. The laminate can be one or more fiber reinforced composite laminates (the first embodiment), or one or more sheet metal material laminates (the second embodiment). The laminate forms a loop 111 around the insert 108. Two distinct arms 110 are formed from the loop 111, and the loop 111 is also divided into a distal half 118 and a proximate half 119. The jacket includes a central portion 120 and an upper portion 122. The cavity 130 includes lugs 140 that extend inward to form a narrow portion in the cavity, the lugs 140 functioning to engage the jacket as the blade is force outward from the cavity due to a centrifugal load.

A critical point 150 is formed where the laminates that are bonded together to form the neck portion 106 and the airfoil portions 105 of the blade digress (or, separate) from each other and wrap around the insert. It is at this critical point 150 in which the blade will delaminate under extreme centrifugal loading that create the tensile stress T that acts to pull the laminates apart.

The jacket 112 is fitted around the root portion 107 and the neck portion 106 of the blade 100, and includes a middle portion of greater thickness than of the central portion 120 or the upper portion 122. The middle portion with the thicker dimension is position near to the critical point 150 and formed at such an angle a with the disk lug 140 that a compressive force in developed against the laminate at the critical point, this compressive force being greater than the force resulting from the tensile load that would cause delamination. The particular dimensions of the jacket 112 and the blade 100 are not limited to the ratios and proportions shown in FIGS. 4 and 5. FIG. 4 illustrates one possible configuration, where the jacket has a thickness "F" at its central portion 120. This thickness need not be very thin or very thick, and does not significantly affect the performance of the present invention, If the arms 110 have a thickness "t", then the thickness of the jacket 112 will be such that it generally conforms to the contours of the inner surface of slot 130 and the outer surface of the root portion 107, where the radius of curvature "r" of the inner face of the upper portion 122 of the jacket 112, proximate to the interface of the root portion 107 and the neck portion 106, is about equal to thickness "t" of the arms 110. The thickness "t" will vary depending on the particular composite blade, but radius "r" will generally be approximate to thickness "t". in addition, the angle a shown as the slope of the outer surface of the jacket 112 at its thickest point will be in the range of 30 +/−10 degrees (20 to 40 degrees). This variation is required to accommodate various rotor disk materials with different stress capabilities (such as titanium, steel, etc.).

Figure 4A:
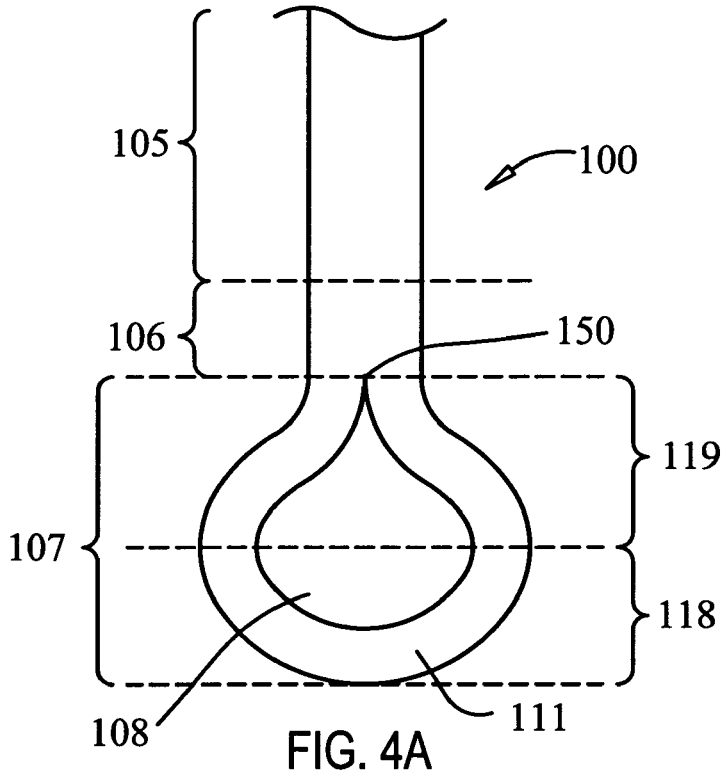
FIG. 4A shows a cross sectional view of only the turbine blade displayed in the turbine blade root attachment mechanism of FIG. 4.

FIG. 4A shows a cross-sectional view of only the blade 100 displayed in the slot 130 of the rotor disk 101 shown in FIG. 4. The blade 100 includes the airfoil portion 105, the neck portion 106, and the root portion 107. A loop 111 of the root portion 107 completely envelops and circumscribes an inner core member or insert 108, which in this embodiment is teardrop shaped. The loop 111 includes a distal half 118 and a proximal half 119. The critical point 150 is shown at the intersection of the loop portion 107 and the neck portion 106, which is at the point where the laminates digress or separate away from one another to form the loop 111.

Figure 4B:
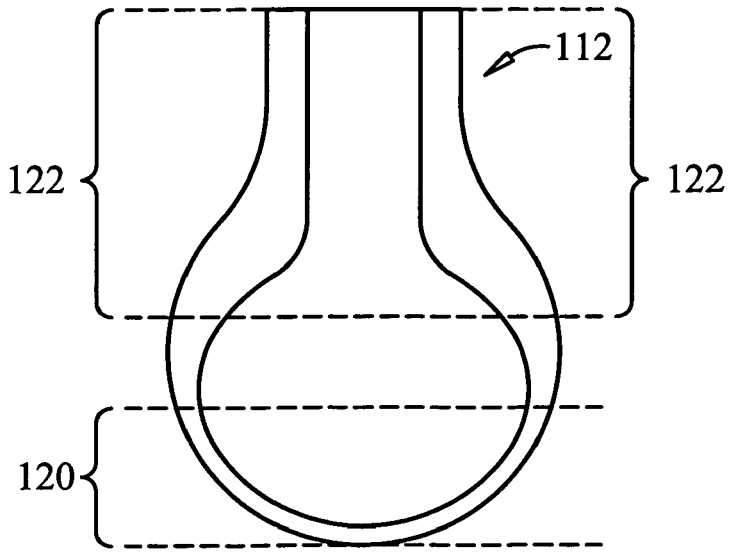
FIG. 4B shows a cross sectional view of only the jacket displayed in the turbine blade root attachment mechanism.

FIG. 4B shows a cross-sectional view of only the jacket 112 displayed in the blade root attachment mechanism of FIG. 4. The jacket 112 is substantially U-shaped and includes a central portion 120 and two end portions 122. The central portion 120 is in opposition with the distal half 118 of the loop 111, while the end portions 122 are disposed against opposite sides of the neck portion 106. The central portion 120 has a thickness that is substantially less than the two end portions 122. Each of the two end portions 122 of the jacket 112 has a thickness that gradually increases from the thickness of the central portion 120 as the two end portions 122 extend over the proximal half 119 of the loop 11, as shown in FIG. 4.

The jacket 112 shown in FIG. 4 shows the two end portions 122 extending all the way to the outer surface 135 of the disk rotor 101. As far as the present invention is concerned, the jacket has to extend to a point just above or past the critical point such that the above-described compressive force can be developed to prevent delamination of the laminates at the critical point and beyond. Further, the jacket 112 is of such shape that the jacket 112 acts as a shim to hold the root portion 107 of the blade 100 within the slot 130 of the rotor disk 101.

Figure 5:
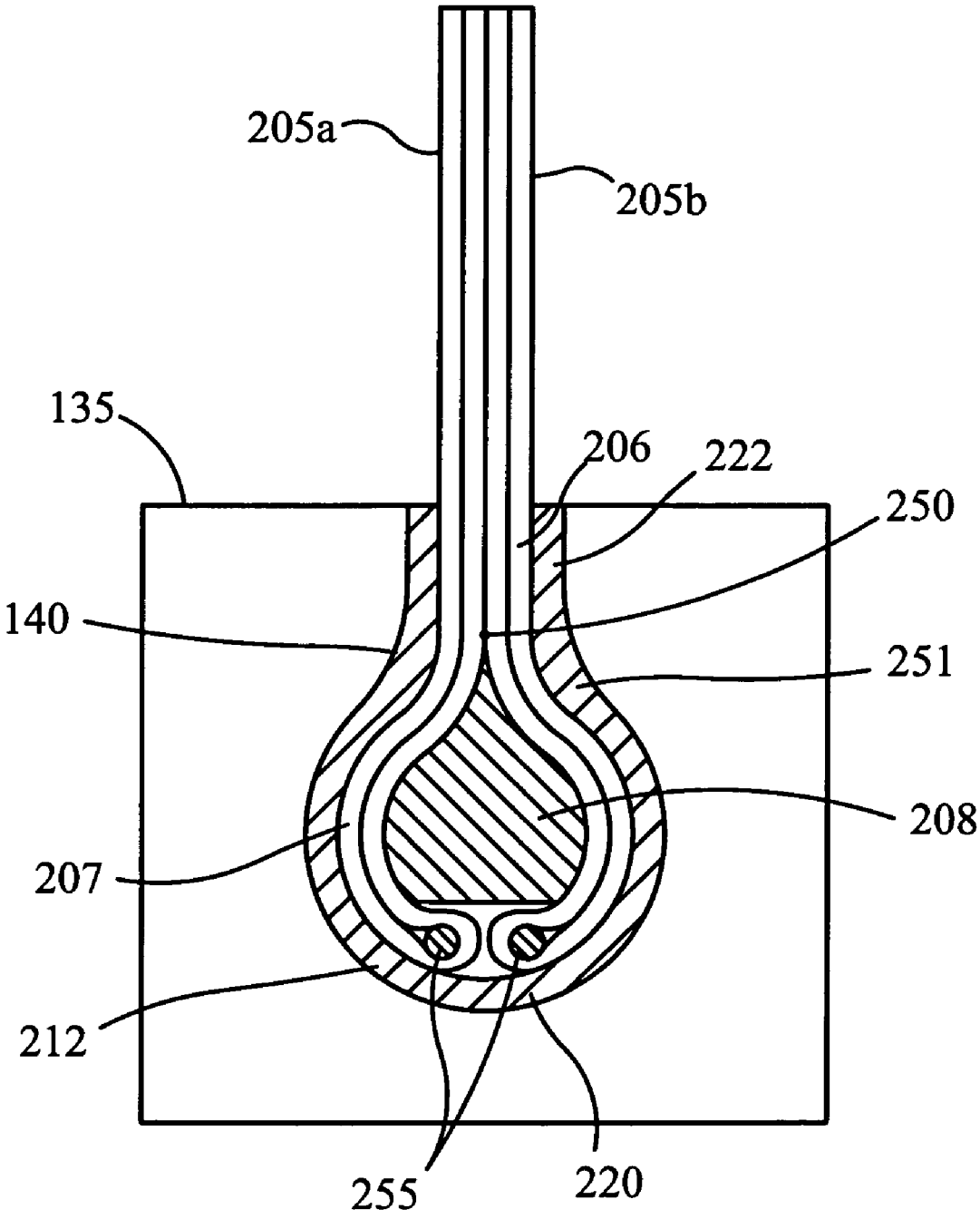
FIG. 5 shows a cross-sectional view of the blade having two loop portions forming the pressure side root and airfoil portions, and the suction side root and airfoil portions of the blade, each loop portion including a respective pin member in which the loop is wrapped around, and a jacket wrapped around the root portion of the blade.

A third embodiment of the present invention is shown in FIG. 5. A blade includes a root portion 207, a neck portion 206, and an airfoil portion 205 including a pressure side 205*a* and a suction side 205*b*. The root 207 is again of the teardrop shape, and formed around an insert 208. In this embodiment, two pins 255 are located in the bottom portion of the root. One laminate that forms the pressure side 205*a* of the blade is wrapped around one pin 255, while another laminate that forms the suction side 205*b* of the blade is wrapped around the other pin 255. In this embodiment, the blade is not formed of a continuous loop wrapped around an insert, but from two loops wrapped around a respective pin 255 secured in the root portion 207 of the blade. A jacket 212 is wrapped around the root portion 107 and the neck portion 106 of the blade, and has the same shape as in the previous embodiments for the purpose of performing the same function of developing a compressive force on the laminates to prevent delamination as in the previous embodiments. A critical point 250 also exists in the third embodiment, and is located at the point shown in FIG. 5 where the pressure side laminates digress from the suction side laminates.

In the third embodiment of FIG. 5, the laminates can be either a fiber-reinforced composite laminate or a sheet metal material. Also, one or more laminates of either material can be used. If multiple laminates are used on each of the two pressure side and suction side portions of the blade, then multiple laminates will be wrapped around each of the pins 255. In the third embodiment of FIG. 5, the bottom of the insert 208 is removed in order to provide a space for the pins 255. The pins 255 are sized and the space is so shaped to provide for the pins and the wrapped laminates to fit between the insert 208 and the bottom 220 of the jacket 212 while preventing the wrapped laminates and the pins 255 from being pulled from this space and between the narrower path between the jacket 212 and the insert 208.

A method of forming the laminated turbomachinery blade according to the first and second embodiments of the present invention is described next. An insert 108 is positioned such that a laminate can be wrapped around it. A laminate of either a fiber reinforced composite material or of a sheet metal material having a predetermined length and width is wrapped around the insert such that the two ends of the laminate are equally spaced from the insert. In the case of the laminates being of the fiber reinforced composite laminates, the assembly is then placed in a mold conforming to a finished shape of the blade and heat is applied such that the laminate is bonded together to form the neck portion and the airfoil portion of the blade. A resin is also injected into the mold to fill any space remaining within the mold such as around the insert. A second laminate can be applied around the first laminate by wrapping the second laminate around the insert (which is now covered by the first laminate), extending the arms of the laminate to form the neck and the airfoil portions, and bonding the second laminate to the first laminate. The bonding process can be one of many well-known methods of bonding thermoplastic or thermosetting resins together. In the case of the laminate(s) being a sheet metal material, the assembly is placed in a mold conforming to the finished shape of the blade and the laminate(s) are pressed together to form the finished shape. The laminate(s) are then bonded together by metal brazing or any other well-known technique used for joining metal sheets together. Then, a jacket having a predetermined shape is wrapped around the root portion and the neck portion of the blade and secured to the root and neck by a bonding process.

A method of forming the laminated turbomachinery blade according to the third embodiment of the present invention is described next. An insert 208 is positioned such that a laminate can be wrapped around it. Two pins 255 are provided such that a first and a second laminate can be wrapped around the first and second pin. A first laminate is wrapped around the first pin 255, and a second laminate is wrapped around the second pin, the first laminate extending along the pressure side of the insert 208, the second laminate extending along the suction side of the insert 208. The assembly is placed in a mold conforming to a finished shape of the blade and heat is applied to bond the laminates together (in the case of the laminates being of the fiber reinforced composite material). A resin is also injected into the mold to fill any space remaining within the mold such as around the insert. If the laminate is of the sheet metal material, then the process described above for the metal material for bonding is used. In the third embodiment, one or more laminates can be wrapped around each of the pins 255 for form multiple laminates on each of the pressure and suction sides of the blades. Then, a jacket having a predetermined shape is wrapped around the root portion and the neck portion of the blade and secured to the root and neck portions by a bonding process.

In the embodiments that make use of a fiber reinforced composite laminated material, the blade can be formed by any well-known plastic injection molding process. Instead of starting with a thermoplastic or thermosetting laminate (a sheet of fibers embedded in a resin matrix) and applying heat to cure the material, fibers such as carbon or glass can be wrapped around the insert or the pins and placed in a mold having the finished shape of the blade. Then, a resin is injected under high pressure into the mold and heat is applied to cure the materials.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A turbomachinery blade, comprising:

a root insert;

at least one laminate forming an airfoil portion and a neck portion of the blade, the at least one laminate extending along at least one side of the root insert and joining at a critical point; and a jacket disposed around the root insert and the neck of the blade, the jacket having a middle portion of greater thickness than at least one other portion of the jacket such that a compressive force is formed against the at least one laminate at the critical point to prevent delamination due to centrifugal force acting on the blade.

2. The turbomachinery blade of claim 1, wherein the jacket defines an outer surface having a slope in the range of approximately 20 degrees to approximately 40 degrees.

3. The turbomachinery blade of claim 1, wherein the middle portion of the jacket defines a thickness having approximately the same radial height as the critical point of the at least one laminate.

4. The turbomachinery blade of claim 1, wherein the at least one laminate is a metal sheet bonded together at the neck portion and the airfoil portion.

5. The turbomachinery blade of claim 1, wherein the at least one laminate is a fiber reinforced sheet bonded together at the neck portion and the airfoil portion.

6. The turbomachinery blade of claim 1, wherein the at least one laminate extends around the root insert.

7. The turbomachinery blade of claim 1, wherein the at least one laminate includes two laminates, and wherein each laminate is wrapped around a separate pin held between the root insert and the jacket.

8. The turbomachinery blade of claim 1, wherein the root insert defines a teardrop cross sectional shape.

9. A rotor disk for a turbomachine, the rotor disk comprising:

a plurality of cavities including a disk lug for each cavity, the cavities having a shape to secure a blade within;

a blade having at least one laminate wrapped around a portion of a root insert, the at least one laminate joining at a critical point; and a jacket positioned between the cavity and the root insert, the jacket having a middle portion of greater thickness than at least one other portion of the jacket such that a compressive force is formed against the at least one laminate at the critical point to prevent delamination, wherein the middle portion of the jacket defines a thickness having approximately the same radial height as the critical point of the at least one laminate.

10. A rotor disk for a turbomachine, the rotor disk comprising:

a plurality of cavities including a disk lug for each cavity, the cavities having a shape to secure a blade within;

a blade having at least one laminate wrapped around a portion of a root insert, the at least one laminate joining at a critical point; wherein the at least one laminate includes two laminates, and wherein each laminate is wrapped around a separate pin held between the root insert and the jacket, and a jacket positioned between the cavity and the root insert, the jacket having a middle portion of greater thickness than at least one other portion of the jacket such that a compressive force is formed against the at least one laminate at the critical point to prevent delamination.

11. A rotor disk for a turbomachine, the rotor disk comprising:

a plurality of cavities including a disk lug for each cavity, the cavities having a shape to secure a blade within;

a blade having at least one laminate wrapped around a portion of a root insert and defining a neck portion, the at least one laminate joining at a critical point; and a jacket positioned between the cavity and the root insert, wherein the jacket is disposed around the root insert and neck portion, the jacket having a middle portion of greater thickness than at least one other portion of the jacket such that a compressive force is formed against the at least one laminate at the critical point to prevent delamination.

12. The rotor disk of claim 11, wherein the jacket defines an outer surface having a slope in the range of approximately 20 degrees to approximately 40 degrees with respect to a longitudinal axis of the rotor disk.

13. The rotor disk of claim 11, wherein the at least one laminate is a metal sheet bonded together at the neck portion and the airfoil portion.

14. The rotor disk of claim 11, wherein the at least one laminate is a fiber reinforced sheet bonded together at the neck portion and the airfoil portion.

15. The rotor disk of claim 11, wherein the root insert defines a teardrop cross sectional shape.

* * * * *